United States Patent [19]

Hankey

[11] Patent Number: 4,536,328

[45] Date of Patent: Aug. 20, 1985

[54] ELECTRICAL RESISTANCE COMPOSITIONS AND METHODS OF MAKING THE SAME

[75] Inventor: Dana L. Hankey, Exton, Pa.

[73] Assignee: Heraeus Cermalloy, Inc., W. Conshohocken, Pa.

[21] Appl. No.: 615,204

[22] Filed: May 30, 1984

[51] Int. Cl.[3] ..... H01B 1/06

[52] U.S. Cl. ..... 252/518; 252/519; 252/520; 252/521; 427/101; 427/102; 427/126.1; 427/126.3; 427/126.6; 427/126.5; 29/620

[58] Field of Search ..... 252/518, 521, 519, 520; 423/593; 427/96, 101, 102, 123, 126.6, 126.1, 126.5, 126.3; 338/308; 29/610 R, 620, 621

[56] References Cited

U.S. PATENT DOCUMENTS

| | | | |
|---|---|---|---|
| 3,304,199 | 2/1967 | Faber, Sr. et al. | 428/426 |
| 3,324,049 | 6/1967 | Holmes | 252/514 |
| 3,655,440 | 4/1972 | Brady | 252/514 |
| 3,682,840 | 8/1972 | Van Loan | 252/518 |
| 4,065,743 | 12/1977 | Wahlers et al. | 338/308 |
| 4,101,708 | 7/1978 | Larry | 252/518 |
| 4,163,706 | 8/1979 | Horowitz et al. | 252/518 |
| 4,225,469 | 9/1980 | Horowitz et al. | 252/518 |
| 4,302,362 | 11/1981 | Hoffman et al. | 252/521 |
| 4,311,730 | 1/1982 | Pedder | 427/102 |
| 4,311,980 | 1/1982 | Prudenziati | 338/4 |
| 4,312,332 | 1/1982 | Zick | 128/635 |
| 4,312,770 | 1/1982 | Yu et al. | 252/514 |
| 4,316,920 | 2/1982 | Brown et al. | 427/96 |
| 4,316,942 | 2/1982 | Kuo | 428/432 |
| 4,320,165 | 3/1982 | Cash | 425/213 |
| 4,328,531 | 5/1982 | Nagashima et al. | 361/401 |
| 4,332,081 | 6/1982 | Francis | 29/612 |
| 4,343,833 | 8/1982 | Sawae et al. | 427/96 |
| 4,355,692 | 10/1982 | Ostrelich | 177/211 |
| 4,362,656 | 12/1982 | Hormadaly | 252/518 |
| 4,372,037 | 2/1983 | Scapple et al. | 29/613 |
| 4,373,018 | 2/1983 | Watanabe et al. | 430/502 |
| 4,377,944 | 3/1983 | Hishii et al. | 73/23 |
| 4,381,476 | 4/1983 | Adachi et al. | 315/101 |
| 4,390,784 | 6/1983 | Browning et al. | 250/287 |
| 4,401,709 | 8/1983 | Prabhu et al. | 428/209 |
| 4,415,624 | 11/1983 | Prabhu et al. | 252/519 |
| 4,424,251 | 1/1984 | Sugishita et al. | 428/209 |
| 4,435,691 | 3/1984 | Ginn | 338/125 |
| 4,436,829 | 3/1984 | Howell | 252/518 |
| 4,443,782 | 4/1984 | d'Ange d'Orsay | 338/195 |

FOREIGN PATENT DOCUMENTS 2115814 4/1973 Fed. Rep. of Germany .

OTHER PUBLICATIONS

English Language Translation of German Patent 21 15 814 (8-pgs), Resistant Paste and Method of Manufacturing a Thick-Film Electric Resistor.

*Primary Examiner*—Josephine L. Barr

*Attorney, Agent, or Firm*—Sprung, Horn, Kramer & Woods

[57] ABSTRACT

A composition for making electrical resistance elements including a conductive component which comprises (a) a precious metal oxide of the formula $A'_{1-x}A''_xB'_{1-y}B''_yO_3$, wherein when A' is Sr; A'' is one or more of Ba, La, Y, Ca and Na, and when A' is Ba, A'' is one or more of Sr, La, Y, Ca and Na; B' is Ru; B'' is one or more of Ti, Cd, Zr, V and Co, $O<x<0.2$; $O<y<0.2$;

(b) a binder component which comprises (i) between 40 weight percent and 75 weight percent C', wherein C' is SrO when A' is Sr, C' is BaO when A' is Ba, and C' is SrO+BaO when A' is Sr and A'' is Ba and when A' is Ba and A'' is Sr, (ii) between 20 weight percent and 35 weight percent $B_2O_3$, (iii) between 2 weight percent and 12 weight percent $SiO_2$, and (iv) between 0.5 weight percent and 6.5 weight percent ZnO. The method of the present invention includes mixing the conductive component and binder as described above with an organic vehicle.

35 Claims, No Drawings

ELECTRICAL RESISTANCE COMPOSITIONS AND METHODS OF MAKING THE SAME

BACKGROUND OF THE INVENTION

The present invention concerns electrical resistance elements and, in particular, compositions for making electrical resistance elements and methods of making the same.

Electrical resistance elements formed from certain compositions are particularly useful in producing microminiature circuitry for the electronics industry wherein electronic elements (or pastes) are screen printed onto substances.

U.S. Pat. No. 3,304,199 describes an electrical resistance element composed of a mixture of $RuO_2$ or $IrO_2$ and lead borosilicate glass. The mixture is combined with a vehicle, e.g., organic screening agent, such as ethyl cellulose dissolved in acetone-toluene. The resultant mixture containing the vehicle is applied onto a nonconductive substrate and then air fired.

U.S. Pat. No. 3,324,049 describes a cermet resistance material comprising 40 to 99 weight percent of a lead borosilicate glass, 0.5 to 20 weight percent of a noble metal such as Ag, Au, Pd, Pt, Rh, Ir, Os or Ru and 0.5 to 40 weight percent $MnO_2$ or CuO. The resultant resistance material is then fired in air.

U.S. Pat. No. 3,655,440 concerns a resistance composition including $RuO_2$, $IrO_2$ or PdO, a lead borosilicate glass vitreous binder and an electrically nonconductive crystal growth controlling agent, e.g., alumina comprising submicron inert particles. Such resistance composition is air fired at 975° C. to 1025° C. for 45 minutes to 1 hour.

U.S. Pat. No. 3,682,840 concerns electrical resistor compositions containing lead ruthenate and mixtures thereof with $RuO_2$, in conjunction with lead borosilicate binders.

U.S. Pat. No. 4,065,743 concerns a vitreous enamel resistor containing a glass frit and conductive particles. Such conductive particles include tin oxide and tantalum oxide.

U.S. Pat. No. 4,101,708 is directed to printable compositions of finely divided powder in an inert liquid vehicle for producing film resistors adherent to a dielectric substrate, such compositions including $RuO_2$, glass containing PbO, $Nb_2O_5$, $CaF_2$ and an inert vehicle.

German Patentschrift 21 15 814 concerns a resistance paste for air firing on a ceramic. Such resistance paste includes $BaRuO_3$, $SrRuO_3$ and $CaRuO_3$ in a lead borosilicate glass.

Resistor compositions have been made using Ag-Pd and/or PdO, $RuO_2$, $IrO_2$, and the so-called "du Pont" pyrochlores. The pyrochlore structures are complex oxides with the general formula $A_2B_2O_{6-7}$ where the large cation A is in eightfold coordination and the smaller B cation is octahedrally coordinated. Their success is largely based on their stability in variable atmospheres (reducing) and their ability for handling multisubstitution of elements to alter electrical properties. Examples of pyrochlores specifically used in these compositions and discussed in U.S. Pat. Nos. 3,553,109; 3,560,410 and 3,583,931 (all of these patents involve lead borosilicate binders) include $Bi_2Ru_2O_7$ and $Pb_2Ru_2O_{7-x}$ where $O<x<1$.

The resistivities of various precious metal oxides (including primarily pyrochlores and some perovskites) were tabulated by Bube, K., *Proceedings of Inter. Microel. Symp.*, Oct. 30–Nov. 1, 1972, Washington, D.C., ISHM, as follows:

| Oxide | $\rho$300° K. $\Omega$-cm |
|---|---|
| Rutile | |
| $RuO_2$ | $3.5 \times 10^{-5}$ |
| $IrO_2$ | $4.9 \times 10^{-5}$ |
| $Rh_2O_3$ | $<10^{-4}$ |
| Pyrochlore | |
| $Bi_2Ru_2O_7$ | $2.3 \times 10^{-2}$ |
| $Bi_2Rh_2O_{6.8}$ | $3.2 \times 20^{-3}$ |
| $Bi_2Ir_2O_7$ | $1.5 \times 10^{-3}$ |
| $Pb_2Ru_2O_6$ | $2.0 \times 10^{-2}$ |
| $Pb_2Ru_2O_{6.5}$ | $5.0 \times 10^{-4}$ |
| $Pb_2Rh_2O_7$ | $6.0 \times 10^{-1}$ |
| $Pb_2Ir_2O_{6.5}$ | $1.5 \times 10^{-4}$ |
| $Pb_2Os_2O_7$ | $4.0 \times 10^{-4}$ |
| $Tl_2Ru_2O_7$ | $1.5 \times 10^{-2}$ |
| $Tl_2Ir_2O_7$ | $1.5 \times 10^{-3}$ |
| $Tl_2Rh_2O_7$ | $6.0 \times 10^{-4}$ |
| $Tl_2Os_2O_7$ | $1.8 \times 10^{-4}$ |
| Perovskite | |
| $LaRuO_3$ | $4.5 \times 10^{-3}$ |
| $La_{.5}Sr_{.5}RuO_3$ | $5.6 \times 10^{-3}$ |
| $CaRuO_3$ | $3.7 \times 10^{-3}$ |
| $SrRuO_3$ | $2.0 \times 10^{-3}$ |
| $BaRuO_3$ | $1.8 \times 10^{-2}$ |

The perovskite crystal structure was described in Goldsmith, U. M., *Skrifter Norske Videnskaps—Akad.*, Oslo, I: Mat. Nuturv.Kl. 2:8 (1926). In the perovskite composition of $ABO_3$ the A cation is in twelve-fold coordination with oxygen and the smaller B cation is in octahedral coordination. This perovskite structure is one of high lattice energy and is generally a very stable structure.

Resistance compositions have been applied in screen printing techniques requiring firing in an oxidizing (air) atmosphere which necessitated the use of expensive noble metals such as Au, Ag, Pt and Pd. Less expensive copper as a base metal could not be employed since copper easily oxidizes. Accordingly, there is a need for a stable copper compatible resistance composition that could be fired in non-oxidizing atmospheres, e.g., nitrogen.

Typical previously employed resistance compositions utilized lead borosilicate glass binders. After firing in air, resistance compositions including, for example, strontium ruthenate in a lead borosilicate binder, the strontium would decompose to strontium oxide, which dissolves into the binder, and ruthenium oxide. In the present invention when, for example, strontium ruthenate in a strontium borosilicate binder is fired in nitrogen, there is no decomposition of the conductive component, i.e., the strontium ruthenate remains unchanged.

SUMMARY OF THE INVENTION

One object of the present invention is to provide stable copper compatible resistance compositions that can be fired in non-oxidizing atmospheres.

Another object of the present invention is to provide a thick film resistor system which exhibits property reproducibility and reduced processing sensitivity.

The present invention concerns a composition for making electrical resistance elements composed of an electrically conductive component and a binder component.

The conductive component includes a precious metal oxide of the formula $A'_{1-x}A''_xB'_{1-y}B''_yO_3$, wherein when A′ is Sr, A″ is one or more of Ba, La, Y, Ca and Na, and when A′ is Ba, A″ is one or more of Sr, La, Y, Ca and Na; B′ is Ru; B″ is one or more of Ti, Cd, Zr, V and Co; $O<x<0.2$; and $0<y<0.2$.

The binder component includes:

between 40 weight percent and 75 weight percent C′, wherein C′ is SrO when A′ is Sr, C′ is BaO when A′ is Ba and C′ is SrO+BaO when A′ is Sr and A″ is Ba and when A′ is Ba and A″ is Sr;

between 20 weight percent and 35 weight percent $B_2O_3$, between 2 weight percent and 15 weight percent $SiO_2$, and between 0.5 weight percent and 6.5 weight percent ZnO.

The present invention also concerns a method of preparing a composition for making an electrical resistor. Such method includes combining a conductive component of the formula $A'_{1-x}A''_xB'_{1-y}B''_yO_3$ wherein when A′ is Sr, A″ is one or more of Ba, La, Y, Ca and Na, and when A′ is Ba, A″ is one or more of Sr, La, Y, Ca and Na; B′ is Ru; B″ is one or more of Ti, Cd, Zr, V and Co; $O<x<0.2$; $O<y<0.2$; a binder having 40 to 75 weight percent C′ (C′ as defined hereinabove), 20 to 35 weight percent $B_2O_3$, 2 to 15 weight percent $SiO_2$, and 0.5 to 6.5 weight percent ZnO, and an organic vehicle to form a paste.

The binder component can also include between 0.1 and 2.5 weight percent $Al_2O_3$.

The binder component can further include between 0.1 weight percent and 1.5 weight percent each of one or more of $Bi_2O_3$, CuO, MgO, or $Nb_2O_5$.

The binder component can also further include between 0.1 weight percent and 1.5 weight percent $TiO_2$ or NaF. The binder component may also further include between 5 weight percent and 15 weight percent CaO.

DETAILED DESCRIPTION OF THE INVENTION

The compositon for making electrical resistance elements of the present invention includes a conductive metal oxide perovskite component and a glass binder component.

The conductive component is represented by the formula $A'_{1-x}A''_xB'_{1-y}B''_yO_3$ wherein when A′ is Sr; A″ is one or more of Ba, La, Y, Ca, and Na, and when A′ is Ba, A″ is one or more of sr, La, Y, Ca and Na; B′ is Ru; B″ is one or more of Ti, Cd, Zr, V and Co; $O<x<0.2$; and $O<y<0.2$. Preferred combinations of $B'_{1-y}B''_y$ include $Ru_{0.8}Ti_{0.2}$ and $Ru_{0.9}Ti_{0.1}$. Preferred conductive components include $SrRu_{0.8}Ti_{0.2}O_3$, $SrRuO_3$ and $SrRu_{0.9}Ti_{0.1}O_3$. Combinations of these components may also be used, such as $SrRuO_3+SrRu_{0.8}Ti_{0.2}O_3$ or $SrRuO_3+SrRu_{0.9}Ti_{0.1}O_3$. Other non-limiting examples of conductive components include $SrRu_{0.95}Cd_{0.05}O_3$, $Sr_{0.90}Na_{0.10}RuO_3$, $Sr_{0.90}Y_{0.10}RuO_3$, $Sr_{0.80}Na_{0.10}La_{0.10}RuO_3$ and $SrRu_{0.8}Ti_{0.2}O_3/SrRuO_3$, $SrRu_{0.8}Zr_{0.2}O_3$, $SrRu_{0.9}Zr_{0.1}O_3$, $SrRu_{0.75}V_{0.25}O_3$ and $SrRu_{0.8}Co_{0.2}O_3$.

The formula $A'_{1-x}A''_xB'_{1-y}B''_yO_3$ can be altered by partial substitutions of A, B or A and B (A is A′+A″; B is B′+B″), such as described above and by using other substitutions. Non-limiting examples of substitutions (based on ionic radii and valency) on the A or B sites are as follows:

| $A^{2+}$ site | $B^{4+}$ site |
|---|---|
| $K^+$ | $Sc^{3+}$ |
| $Cu^+$ | $Mn^{3+}$ |
| $Ag^+$ | $Fe^{3+}$ |
| $Ce^{3+}$ | $Ta^{5+}$ |
| $Nd^{3+}$ | $Al^{3+}$ |
| $Sm^{3+}$ | $Gd^{3+}$ |
| $Mg^{2+}$ | $Bi^{3+}$ |
| | $Nb^{5+}$ |
| | $Sb^{5+}$ |
| | $Mo^{6+}$ |
| | $W^{6+}$ |

The binder component of the present invention has as its major constituents C′, i.e., SrO or BaO or SrO+BaO; $B_2O_3$; $SiO_2$; and ZnO in the following amounts:

| Constituent | Weight % Range | Preferred Wt. % Range |
|---|---|---|
| C′ | 40 to 75 | 42 to 58 |
| $B_2O_3$ | 20 to 35 | 27 to 31 |
| $SiO_2$ | 2 to 15 | 7 to 11 |
| ZnO | 0.5 to 6.5 | 2 to 4 |

Additionally, the binder component may have included therein one or more of the following constituents:

| Constituent | Weight % Range | Preferred Wt. % Range |
|---|---|---|
| $Al_2O_3$ | 0.1 to 2.5 | 0.5 to 15 |
| $Bi_2O_3$ | 0.1 to 1.5 | 0.4 to 1 |
| CuO | 0.1 to 1.5 | 0.3 to 0.8 |
| MgO | 0.1 to 1.5 | 0.4 to 0.8 |
| $Nb_2O_5$ | 0.1 to 1.5 | 0.3 to 0.8 |
| NaF | 0.1 to 1.5 | 0.2 to 0.9 |
| $TiO_2$ | 0.1 to 1.5 | 0.2 to 0.6 |

Non-limiting examples of preferred binder component formulations include the following:

| Component | Formulation I Wt. % | Formulation II Wt. % | Formulation III Wt. % |
|---|---|---|---|
| SrO | 51.7 | 55.2 | 56.6 |
| $B_2O_3$ | 30.0 | 30.0 | 30.1 |
| $SiO_2$ | 10.5 | 7.0 | 7.1 |
| $Al_2O_3$ | 1.1 | 1.1 | 0.5 |
| ZnO | 3.4 | 3.4 | 3.4 |
| $Bi_2O_3$ | 0.5 | 0.5 | 0.5 |
| CuO | 0.6 | 0.6 | 0.6 |
| MgO | 0.7 | 0.7 | 0.7 |
| $Nb_2O_5$ | 0.5 | 0.5 | 0.5 |
| NaF | 0.5 | 0.5 | — |
| $TiO_2$ | 0.5 | 0.5 | — |

Examples of other non-limiting examples of binder formulations include the following:

| Component | Wt. % | Wt. % | Wt. % | Wt. % | Wt. % |
|---|---|---|---|---|---|
| SrO | 51.7 | 52.2 | 53.2 | 42.2 | 54.7 |
| $B_2O_3$ | 30.1 | 30.0 | 30.0 | 30.0 | 30.0 |
| $SiO_2$ | 10.5 | 10.0 | 9.0 | 7.5 | 7.5 |
| $Al_2O_3$ | 1.1 | 1.1 | 1.1 | 1.1 | 1.1 |
| ZnO | 3.4 | 3.4 | 3.4 | 3.4 | 3.4 |
| $Bi_2O_3$ | 0.5 | 0.5 | 0.5 | 0.5 | 0.5 |
| CuO | 0.6 | 0.6 | 0.6 | 0.6 | 0.6 |
| $TiO_2$ | — | 0.5 | 0.5 | 0.5 | 0.5 |
| MgO | 1.1 | 0.7 | 0.7 | 0.7 | 0.7 |
| $Nb_2O_5$ | 0.5 | 0.5 | 0.5 | 0.5 | 0.5 |
| NaF | 0.5 | 0.5 | 0.5 | 0.5 | 0.5 |

-continued

| Component | Wt. % | Wt. % | Wt. % | Wt. % | Wt. % |
|---|---|---|---|---|---|
| CaO | — | — | — | 12.5 | — |

The weight percent loading of binder component/-conductive component can vary from 25 wt.% to 75 wt.% binder/75 wt.% to 25 wt.% conductive component, i.e., wt.% binder can be, for example, 30 wt.%, 35 wt.%, 40 wt.%, 50 wt.%, 60 wt.%, 65 wt.% and 70 wt.%.

The binder component and conductive component are mixed together with a suitable "organic vehicle". An organic vehicle is a medium which volatilizes at a fairly low temperature (approximately 400° C.–500° C.), without causing reduction of other paste components. An organic vehicle acts as a transfer medium for screen printing. An organic vehicle for use in the present invention is preferably a resin, e.g., an acrylic ester resin, preferably an isobutyl methacrylate, and a solvent, e.g., an alcohol, preferably tri-decyl alcohol ("TDA"). The resin can be any polymer which depolymerizes at or below 400° C. in nitrogen. Other solvents that can be employed are terpineol or "TEXANOL" of Eastman Kodak. The solvent for utilization in the present invention can be any solvent which dissolves the respective resin and which exhibits a suitable vapor pressure consistent with subsequent milling and screen printing. In a preferred embodiment, the organic vehicle is 10 to 30 weight percent isobutyl methacrylate and 90 to 70 weight percent TDA.

The binder component, conductive component and organic vehicle are mixed, screen printed on Cu termination on a suitable substrate, e.g., 96% $Al_2O_3$ and then fired in a nitrogen atmosphere at a high temperature, e.g., 900° C., for a suitable period of time, e.g., 7 minutes.

In preparing compositions for making electrical resistance elements according to the present invention, the conductive component, binder component and organic vehicle are combined to form a paste. The paste is then milled to the required fineness for screen printing techniques.

Without wishing to be bound by any particular theory of operability, it is believed that the binder component (glass matrix) of the present invention prevents decomposition of the conductive component during firing, i.e., the crystal structure (physical) and chemical composition of the conductive component remains stable and unchanged during firing.

EXAMPLES

Example 1—Binder Preparation

Binders were synthesized utilizing reagent grade raw materials, each in the oxide form with the exception of strontium, barium and copper compounds which were in the carbonate form. When the composition was formulated, the individual components were weighed and homogenized for one (1) hour in a V-blender (which is a dry blending operation). After the blending was complete, the homogenized powders were poured into kyanite crucibles in which they would be subsequently melted. The binders were preheated for one (1) hour at 600° C. and then transferred to another furnace where they were melted typically in range of 1100° C. to 1300° C. for 1 to 1.5 hours. The molten material was removed from the furnace at the melting temperature and poured (fritted) into stainless steel buckets filled with deionized water. As the molten stream made contact with the water, solidification and disintegration into glass chunks (size dictated by thermal stresses) occurred. The deionized water was decanted and the glass was placed in a ceramic jar mill with alumina grinding cylinders and an isopropyl alcohol medium. The glasses were ball milled for 24 hours and then wet-sieved through a 200 mesh screen. After drying in a room temperature convection explosion-proof oven, the powders were ready for characterization and incorporation into resistor pastes. The powders ranged in particle size from 1 to 2 μm. Binders prepared as described in the foregoing procedure are those previously identified as Formulations I, II and III. The softening points for Formulations I, II and III were found to be, respectively, 625° C., 635° C. and 660° C. Other binder formulations prepared according to Example 1 include the following:

| Component | Form. IV wt. % | Form. V wt. % | Form. VI wt .% | Form. VII wt. % | Form. VIII wt. % |
|---|---|---|---|---|---|
| BaO | 53.6 | 66.6 | 66.6 | 68.6 | 66.6 |
| SrO | 15.0 | — | — | — | — |
| $B_2O_3$ | 19.2 | 18.2 | 23.4 | 17.2 | 17.2 |
| $SiO_2$ | 8.0 | 8.2 | 8.0 | 9.2 | 11.2 |
| $Al_2O_3$ | — | — | 2.0 | 2.0 | — |
| ZnO | 3.0 | 5.0 | — | 1.0 | 5.0 |
| $TiO_2$ | 0.4 | 0.8 | — | — | — |
| CuO | 0.8 | 0.6 | — | 1.0 | — |
| $Bi_2O_3$ | — | 0.6 | — | 1.0 | — |

Example 2—Conductive Component Preparation

Conductive components were prepared by formulating the respective compound (e.g., $SrRuO_3$), calculating the equimolar amounts of, for example, $SrCO_3$ and $RuO_2$ which must be weighted in order to ensure stoichiometry, and finally weighing the individual components. Correction factors for Ru metal content, water content, and other volatile components lost on ignition at 600° C. are also incorporated into the calculation. A similar correction factor for loss on ignition was incorporated into calculations for the weights of other components, if necessary. The $RuO_2$ had a surface area greater than 70 $m^2/g$, while the other constituents were less than 5 $m^2/g$. The weighed raw materials were ball milled for two (2) hours in ceramic jar mills with alumina grinding media and deionized water, thus, creating a wet milling process. After 2 hours, the homogenized slurry was poured into stainless steel trays and dried for 24 hours at 80° C. The dried blend was passed through an 80 mesh screen prior to calcination.

The meshed powders were calcined in high purity alumina crucibles (99.8% purity) with the cycle being precisely microprocessor-controlled. The heat-up and cool-down rates were not per se critical, but were generally 500° C./hour. The hold times at the respective temperatures (from 800° C. to 1200° C. depending on the compound) varied from one (1) hour to two (2) hours. When the calcination was complete, the powders were milled in a Sweeco-vibratory mill for two (2) hours. This is a high energy milling procedure which utilized alumina grinding media and an isopropyl alcohol medium. The perovskites were wet sieved (200 mesh) at the end of the cycle, dried at room temperature in a convection oven (explosion proof), and prepared for characterization and incorporation into resistor pastes.

Conductive components prepared according to the foregoing procedure included the following:

| Designation | Composition | Calcination Conditions (°C./Hour) |
|---|---|---|
| Composition I | $SrRu_{.8}Ti_{.2}O_3$ | 1200° C./2 hours |
| Composition II | $SrRuO_3$ | 1000° C./2 hours |
| Composition III | $SrRuO_3$ | 800° C./1 hours |
| Composition IV | $SrRu_{.9}Ti_{.1}O_3$ | 1200° C./1 hours |
| Composition V | $SrRu_{.8}Ti_{.1}Zr_{.1}O_3$ | 1200° C./2 hours |

Example 3—Combination of Binders and Conductive Components

The binders as prepared in accordance with Example 1 hereinabove were combined with conductive components prepared in accordance with Example 3 hereinabove, along with an organic vehicle. The organic vehicle utilized was "ACRYLOID" B67 a resin (an isobutyl methacrylate) produced by Rohm & Haas of Philadelphia, Pa., and tri-decyl alcohol ("TDA") in a 30/70 wt.% ratio.

The respective binders, conductive components, and organic vehicle were weighted to make the desired paste blends. The solids content (binder plus conductive phase) was maintained at 70 wt.% of the total paste weight. The pastes were three-roll milled to a fineness of grind of $<10$ μm. Resistor test patterns were screen printed with the following print thicknesses: wet, 29–32 μm; fired, 10–13 μm. The pastes were then printed through either a 325 mesh screen with 0.6 mil-emulsion or a 280 mesh screen with a 0.5 mil-emulsion. The wet prints were dried at 150° C. for 5–10 minutes prior to firing.

The firing profile was dependent on the binder constituent. For example, pastes containing Formulation I were fired at 850° C., while Formulations II and III were fired at 900° C. The 850° C. profile length was 58 minutes from 100° C. to 100° C., i.e., from furnace entrance to furnace exit. The heating rate was 45° C./minute, the cooling rate was 60° C./minute, and the dwell time at peak temperature was 10 minutes. The 900° C. profile had a duration of 55 minutes from 100° C. to 100° C., a heating rate of 50° C./minute, and a cooling rate of 60° C./minute. The time at peak temperature was varied from 5 to 14 minutes.

Various combinations of the aforementioned binder formulations and conductive components to form resistor elements and their resultant properties after firing in nitrogen are given hereinbelow in Tables I and II. In Table II, nitrogen firing in 850° C. was utilized.

TABLE I

BASIC ELECTRICAL PROPERTIES OF RESISTORS FIRED IN NITROGEN

| BINDER//COMP. | WT % LOADING BINDER/COND. COMP. | ρs (CV) HTCR (Ω/□) (ppm/°C.) | CTCR (ppm/°C.) | ΔTCR (ppm/°C.) | VCR (ppm/V/inch) | LASER TRIM DRIFT (24 hr) % ΔR | 85° C./85% RH % ΔR (120 hr) | 150° C. % ΔR (120 hr) | Calc. Conds. (°C./hr) | Firing Temp. (°C.) | Noise (dB) |
|---|---|---|---|---|---|---|---|---|---|---|---|
| FORMULATION I//COMPOSITION II 60//40 | 500 (6) | +400 | +390 | 10 | | | | | 1000/2 | 850 | −4 |
| FORMULATION I//COMPOSITION II/ COMPOSITION I 60//30//10 | 5k (8) | +290 | +280 | 10 | −5 | 0.4 | .2 | .5 | 1000/2 1200/2 | 850 | +5 |
| FORMULATION I//COMPOSITION II/ COMPOSITION I 60//25/15 | 20K (7) | +140 | +125 | 15 | −20 | 0.5 | .2 | .5 | 1000/2 1200/2 | 850 | +13.7 |
| FORMULATION I//COMPOSITION I 60//40 | 500k (12) | −120 | −200 | 80 | | | | | 1200/2 | 850 | |
| FORMULATION I//COMPOSITION II 30//70 | 120 | | | | | | | | 1000/2 | 850 | −14.4 |
| FORMULATION I//COMPOSTION II 70//30 | 900k (35) | +250 | +290 | 40 | | | | | 1000/2 | 850 | |
| FORMULATION III//COMPOSITION III 60//40 | 2k (8) | +650 | +750 | 100 | | | | | 800/1 | 900 | |
| FORMULATION III//COMPOSITION II 60//40 | 3.5k (12) | +485 | +415 | 70 | −8 | 1.00 | 1.29 | .12 | 1000/2 | 900 | |
| FORMULATION III//COMPOSITION II 50//50 | 900 (8) | +750 | +675 | 75 | | .15 | .57 | .20 | 1000/2 | 900 | −4.5 |
| FORMULATION III//COMPOSITION II 30//70 | 95 (2) | +900 | +650 | 250 | | | | | 1000/2 | 900 | |
| FORMULATION III//COMPOSITION I 70//30 | 45k (4) | −275 | −550 | 275 | | | | | 1200/2 | 900 | +11.3 |
| FORMULATION III//COMPOSITION I 60//40 | 40k (4) | | | | | | | | 1200/2 | 900 | −14.7 |
| FORMULATION III//COMPOSITION I 50//50 | 20k (9) | −300 | −560 | 260 | | | | | 1200/2 | 900 | +9.0 |
| FORMULATION III//COMPOSITION I 40//60 | 11k (4) | −240 | −490 | 250 | | | | | 1200/2 | 900 | +8.2 |
| FORMULATION III//COMPOSITION I 30//70 | 400 (5) | +180 | +380 | 200 | | | | | 1200/2 | 900 | −12.5 |
| FORMULATION III//COMPOSITION I 60//40 | 62k (2) | −230 | −440 | 210 | | | | | 1200/2 | 900 | +6.4 |
| FORMULATION III//COMPOSITION I 40//60 | 20k (3) | −185 | −360 | 175 | | | | | 1200/2 | 900 | −15.5 |
| FORMULATION III//COMPOSITION IV 70//30 | 70k (11) | +70 | +50 | 20 | | | | | 1200/2 | 900 | |
| FORMULATION III//COMPOSITION IV 60//40 | 37k (6) | +60 | +30 | 30 | | | | | 1200/1 | 900 | 6.8 |
| FORMULATION III//COMPOSITION IV 50//50 | 19k (3) | +70 | +50 | 20 | | | | | 1200/1 | 900 | 5.4 |
| FORMULATION III//COMPOSITION IV 40//60 | 2.6k | | | | | | | | 1200/1 | 900 | −1.8 |
| FORMULATION III//COMPOSITION IV 30//70 | 147 (2) | +600 | +630 | 30 | | | | | 1200/1 | 900 | |
| FORMULATION III//COMPOSITION II 35//65 | 120 (4) | +750 | +875 | 125 | | | | | 1200/2 | 900 | |
| FORMULATION III//COMPOSITION II | 2.5k (10) | +350 | +400 | 50 | | | | | 1000/2 | 900 | |

TABLE I-continued

BASIC ELECTRICAL PROPERTIES OF RESISTORS FIRED IN NITROGEN

| BINDER//COMP. | WT % LOADING BINDER/COND. COMP. | ρs (CV) HTCR (Ω/□) (ppm/°C.) | CTCR (ppm/°C.) | ΔTCR (ppm/°C.) | VCR (ppm/V/inch) | LASER TRIM DRIFT (24 hr) % ΔR | 85° C./85% RH % ΔR (120 hr) | 150° C. % ΔR (120 hr) | Calc. Conds. (°C./hr) | Firing Temp. (°C.) | Noise (dB) |
|---|---|---|---|---|---|---|---|---|---|---|---|
| 40//60 FORMULATION III//COMPOSITION II | 20k | +190 | +250 | 60 | | | | | 1000/2 | 900 | +9 |
| 50//50 FORMULATION III//COMPOSITION II | 100k (10) | +80 | +90 | 10 | −20 | | | | 1000/2 | 900 | |
| 60//40 FORMULATION III//COMPOSITION V | 320 (1) | +615 | +540 | 75 | | | | | 1200/2 | 900 | |
| 30//70 | | | | | | | | | | | |

GLOSSARY
ρs = sheet resistance
HTCR = hot temperature coefficient of resistance
CTCR = cold temperature coefficeint of resistance
TCR = temperature coefficient of resistance
ΔTCR = the absolute difference of HTCR and CTCR
VCR = voltage coefficient of resistance
(CV) = coefficient of variation expressed as percent

TABLE II

| BINDER//CONDUCTIVE COMPONENT | FIRING CONDITIONS | ρs Ω/□ | HTCR | CTCR | ΔTCR |
|---|---|---|---|---|---|
| FORMULATION VIII//$BaRuO_3$ 50//50 | $N_2$ @ 900° C. | 2K | +400 | +100 | 300 |
| FORMULATION VIII//$BaRu_{.9}Ti_{.1}O_3$ 50//50 | $N_2$ @ 900° C. | 5K | −300 | −800 | 500 |
| FORMULATION VIII//$BaRu_{.9}Zr_{.1}O_3$ 50//50 | $N_2$ @ 900° C. | 20K | −200 | −400 | 200 |
| FORMULATION VIII//$Ba_{.8}Y_{.2}RuO_3$ 50//50 | $N_2$ @ 900° C. | 3.2K | +350 | +150 | 200 |
| FORMULATION VIII//$Ba_{.9}Na_{.1}RuO_3$ 50//50 | $N_2$ @ 900° C. | 1.3K | +500 | +350 | 150 |
| FORMULATION VIII//$BaRuO_3$ 60//40 | $N_2$ @ 900° C. | 30K | −500 | −800 | 300 |
| FORMULATION I//$BaRuO_3$ 65//35 | $N_2$ @ 850° C. | 20K | −400 | −500 | 100 |
| FORMULATION IV//$SrRuO_3$ 75//25 | $N_2$ @ 850° C. | 5 M | −100 | −300 | 200 |
| FORMULATION IV//$BaRuO_3$ 65//35 | $N_2$ @ 850° C. | 20 | +1400 | +1800 | 400 |
| FORMULATION IV//$SrRuO_3$ 75/25 | $N_2$ @ 850° C. | 2 M | 0 | −300 | 300 |
| FORMULATION IV//$SrRuO_3$ 70//30 | $N_2$ @ 850° C. | 320 | +1120 | +1190 | 70 |

It will be appreciated that the instant specification and claims are set forth by way of illustration and not limitation, and that various modifications and changes may be made without departing from the spirit and scope of the present invention.

What is claimed is:

1. A composition for making electrical resistance elements comprising:

a. a conductive component which comprises a precious metal oxide of the formula $A'_{1-x}A''_xB'_{1-y}B''_yO_3$ wherein A' is Sr or Ba, when A' is Sr, A'' is selected from the group consisting of one or more of Ba, La, Y, Ca and Na, and when A' is Ba, A'' is selected from the group consisting of one or more of Sr, La, Y, Ca and Na; B' is Ru; B'' is selected from the group consisting of one or more of Ti, Cd, Zr, V and Co; $O<x<0.2$; and $O<y<0.2$;

b. a binder component which comprises (i) between 40 weight percent and 75 weight percent C', wherein C' is SrO when A' is Sr, C' is BaO when A' is Ba, and C' is SrO+BaO when A' is Sr and A'' is Ba and when A' is Ba and A'' is Sr, (ii) between 20 weight percent and 35 weight percent $B_2O_3$, (iii) between 2 weight percent and 15 weight percent $SiO_2$, and (iv) between 0.5 weight percent and 6.5 weight percent ZnO.

2. A composition according to claim 1, wherein A' is Sr.

3. A composition according to claim 1, wherein A' is Ba.

4. A composition according to claim 1, wherein said binder further comprises between 0.1 and 2.5 weight percent $Al_2O_3$.

5. A composition according to claim 1, wherein C' is between 42 and 58 weight percent, $B_2O_3$ is between 27 and 31 weight percent, $SiO_2$ is between 7 and 11 weight percent and ZnO is between 2 and 4 weight percent.

6. A composition according to claim 1 wherein said binder further comprises between about 0.1 weight percent and 1.5 weight percent each of one or more oxides selected from the group consisting of $Bi_2O_3$, CuO, MgO, and $Nb_2O_5$.

7. A composition according to claim 1, wherein said binder further comprises between 0.1 weight percent and 1.5 weight percent $TiO_2$.

8. A composition according to claim 1, wherein said binder further comprises between 0.1 weight percent and 1.5 weight percent NaF.

9. A composition according to claim 1, wherein said binder further comprises between 5 weight percent and 15 weight percent CaO.

10. A composition according to claim 1, wherein said binder includes 51.7 weight percent SrO, 30.0 weight percent $B_2O_3$, 10.5 weight percent $SiO_2$, 1.1 weight percent $Al_2O_3$, 3.4 weight percent ZnO, 0.5 weight percent $Bi_2O_3$, 0.6 weight percent CuO, 0.7 weight percent MgO, 0.5 weight percent $Nb_2O_5$, 0.5 weight percent $TiO_2$ and 0.5 weight percent NaF.

11. A composition according to claim 1, wherein said binder includes 55.2 weight percent SrO, 30.0 weight percent $B_2O_3$, 7.0 weight percent $SiO_2$, 1.1 weight percent $Al_2O_3$, 3.4 weight percent ZnO, 0.5 weight percent $Bi_2O_3$, 0.6 weight percent CuO, 0.7 weight percent MgO, 0.5 weight percent $Nb_2O_5$, 0.5 weight percent NaF an 0.5 weight percent $TiO_2$.

12. A composition according to claim 1, wherein said binder includes 56.6 weight percent SrO, 30.1 weight percent $B_2O_3$, 7.1 weight percent $SiO_2$, 0.5 weight percent $Al_2O_3$, 3.4 weight percent ZnO, 0.5 weight percent $Bi_2O_3$, 0.6 weight percent CuO, 0.7 weight percent MgO and 0.5 weight percent $Nb_2O_5$.

13. A composition according to claim 1, wherein said conductive component is selected from the group consisting of $SrRuO_3$, $SrRu_{0.8}Ti_{0.2}O_3$, $SrRu_{0.9}Ti_{0.1}O_3$, $SrRu_{0.95}Cd_{0.05}O_3$, $Sr_{0.9}Ba_{0.1}RuO_3$, $Sr_{0.9}Y_{0.1}RuO_3$, $Sr_{0.8}Na_{0.1}La_{0.1}RuO_3$, $SrRu_{0.8}Zr_{0.2}O_3$, $SrRu_{0.9}Zr_{0.1}O_3$, $SrRu_{0.75}V_{0.25}O_3$, $SrRu_{0.8}Co_{0.2}O_3$ and $SrRu_{0.8}Ti_{0.1}Zr_{0.1}O_3$.

14. A composition according to claim 1, further comprising an organic vehicle.

15. A composition according to claim 14, wherein said organic vehicle is a mixture of an acrylic ester resin and an alcohol.

16. A composition according to claim 15, wherein said resin is isobutyl methacrylate and said alcohol is tri-decyl alcohol.

17. A method of forming an electrical resistance element comprising preparing a composition for making electrical resistance elements comprising combining a. a conductive component which comprises a precious metal oxide of the formula $A'_{1-x}A''_xB'_{1-y}B''_yO_3$ wherein A' is Sr or Ba, when A' is Sr, A'' is selected from the group consisting of one or more of Ba, La, Y, Ca and Na and when A' is Ba, A'' is selected from the group consisting of one or more Sr, La, Y, Ca and Na; and B' is Ru; B'' is selected from the group consisting of one or more of Ti, Cd, Zr, V and Co; $O<x<0.2$; and $O<y<0.2$, b. a binder component which comprises (i) between 40 weight percent and 75 weight percent C', wherein C' is SrO when A' is Sr, C' is BaO when A' is Ba, and C' is SrO+BaO when A' is Sr and A'' is Ba and when A' is Ba and A'' is Sr, (ii) between 25 weight percent and 35 weight percent $B_2O_3$, (iii) between 2 weight percent and 12 weight percent $SiO_2$, and (iv) between 0.5 weight percent and 6.5 weight percent ZnO, and c. an organic vehicle to form a paste, thereafter screen printing the paste on a substrate and conducting firing.

18. A method according to claim 17, wherein A' is Sr.

19. A method according to claim 17, wherein A' is Ba.

20. A method according to claim 17, wherein said binder further comprises between 0.1 and 2.5 weight percent, $SiO_2$ is between 2 and 15 weight percent and ZnO is between 0.5 and 6.5 weight percent.

21. A method according to claim 17, wherein A'O is between 42 and 58 weight percent, $B_2O_3$ is between 27 and 31 weight percent, $SiO_2$ is between 2 and 15 weight percent and ZnO is between 0.5 and 6.5 weight percent.

22. A method according to claim 17 wherein said binder further conprises between about 0.1 weight percent and 1.5 weight percent each of one or more oxides of the group consisting of $Bi_2O_3$, CuO, MgO, and $Nb_2O_5$.

23. A method according to claim 17, wherein said binder further comprises between 0.1 weight percent and 1.5 weight percent $TiO_2$.

24. A method according to claim 17, wherein said binder further comprises between 0.1 weight percent and 1.5 weight percent NaF.

25. A method according to claim 17, wherein said binder further comprises between 5 weight percent and 15 weight percent CaO.

26. A method according to claim 17, wherein said binder includes 51.7 weight percent SrO, 30.0 weight percent $B_2O_3$, 10.5 weight percent $SiO_2$, 1.1 weight percent $Al_2O_3$, 3.4 weight percent ZnO, 0.5 weight percent $Bi_2O_3$, 0.6 weight percent CuO, 0.7 weight percent MgO, 0.5 weight percent $Nb_2O_5$, 0.5 weight percent $TiO_2$ and 0.5 weight percent NaF.

27. A method according to claim 17, wherein said binder includes 55.2 weight percent SrO, 30.0 weight percent $B_2O_3$,7.0 weight percent $SiO_2$, 1.1 weight percent $Al_2O_3$, 3.4 weight percent ZnO, 0.5 weight percent $Bi_2O_3$, 0.6 weight percent CuO, 0.7 weight percent MgO, 0.5 weight percent $Nb_2O_5$, 0.5 weight percent NaF and 0.5 weight percent $TiO_2$.

28. A method according to claim 18, wherein said binder includes 56.6 weight percent SrO, 30.1 weight percent $B_2O_3$, 7.1 weight percent $SiO_2$, 0.5 weight percent $Al_2O_3$, 3.4 weight percent ZnO, 0.5 weight percent $Bi_2O_3$, 0.6 weight percent CuO, 0.7 weight percent MgO and 0.5 weight percent $Nb_2O_5$.

29. A method according to claim 18, wherein said conductive component is selected from the group consisting of $SrRuO_3$, $SrRu_{0.8}Ti_{0.2}O_3$, $SrRu_{0.9}Ti_{0.1}O_3$, $SrRu_{0.95}Cd_{0.05}O_3$, $Sr_{0.9}Ba_{0.1}RuO_3$, $Sr_{0.9}Y_{0.1}RuO_3$, $Sr_{0.8}Na_{0.1}La_{0.1}RuO_3$, $SrRu_{0.8}Zr_{0.2}O_3$, $SrRu_{0.9}Zr_{0.1}O_3$, $SrRu_{0.75}V_{0.25}O_3$, $SrRu_{0.8}Co_{0.2}O_3$ and $SrRu_{0.8}Ti_{0.1}Zr_{0.1}O_3$.

30. A method according to claim 17, wherein said organic vehicle is a mixture of an acrylic ester resin and an alcohol.

31. A method according to claim 29, wherein said resin is isobutyl methacrylate and said alcohol is tridecyl alcohol.

32. A method according to claim 17, wherein prior to screen printing, the paste is milled.

33. A method according to claim 17, wherein the screen printing is on Cu termination.

34. A method according to claim 17, wherein the substrate comprises $Al_2O_3$.

35. A method according to claim 17, wherein the firing is conducted in a nitrogen atmosphere.

* * * * *